US006629569B1

(12) United States Patent
Adams

(10) Patent No.: US 6,629,569 B1
(45) Date of Patent: Oct. 7, 2003

(54) POP UP ROOF SPRINKLER SYSTEM

(76) Inventor: Milton D. Adams, 771 S. 690 W, Tooele, UT (US) 84074

( * ) Notice: Subject to any disclaimer, the term of this patent is extended or adjusted under 35 U.S.C. 154(b) by 0 days.

(21) Appl. No.: 10/281,034

(22) Filed: Oct. 25, 2002

(51) Int. Cl.[7] ..... A62C 37/00; A62C 35/00; B05B 15/10; B05B 3/00; B05B 1/26

(52) U.S. Cl. ..... 169/56; 169/16; 239/203; 239/204; 239/208; 239/506

(58) Field of Search ..... 169/56, 16, 20, 169/45; 239/203, 204, 208, 506, 201, 207, 209, 461, 507, 521, 523

(56) References Cited

U.S. PATENT DOCUMENTS 3,179,181 A * 4/1965 Banzato ..... 169/13
3,848,675 A * 11/1974 Evans ..... 169/15
4,091,876 A 5/1978 Valdatta
4,330,040 A 5/1982 Ence et al.
4,372,493 A * 2/1983 Smith ..... 239/208
4,428,434 A 1/1984 Gelaude
4,951,754 A * 8/1990 Solheim ..... 169/15
5,125,458 A * 6/1992 Berman ..... 169/16
5,165,482 A 11/1992 Smagac et al.
5,263,543 A 11/1993 Nigro
5,328,212 A * 7/1994 Kosik et al. ..... 285/42
5,692,571 A 12/1997 Jackson
5,732,511 A * 3/1998 Scott ..... 52/1
D399,553 S 10/1998 Kumagai
6,167,971 B1 * 1/2001 Van Lingen ..... 169/16
6,302,146 B1 * 10/2001 McHugh ..... 137/601.16
6,450,264 B1 * 9/2002 Christian ..... 169/16
6,481,644 B1 * 11/2002 Olsen ..... 239/456
6,523,616 B1 * 2/2003 Wallace ..... 169/70

* cited by examiner

*Primary Examiner*—Michael Mar
*Assistant Examiner*—Darren Gorman

(57) ABSTRACT

A pop up roof sprinkler system includes a building having a roof, a fire retardant solution, a dispensing tube that has a distal portion extending outwardly from the roof, and a cap member. The cap member has a head portion and an insertion portion. The insertion portion is inserted into the dispensing tube such that the cap member is movable between an open position and a closed position. The open position is defined by the head portion being spaced from the dispensing tube to permit dispensation of the fire retardant solution through the dispensing tube.

12 Claims, 3 Drawing Sheets

POP UP ROOF SPRINKLER SYSTEM

BACKGROUND OF THE INVENTION

1. Field of the Invention

The present invention relates to fire prevention devices and more particularly pertains to a new pop up roof sprinkler system for wetting the exterior surface of a building and a portion of the surrounding grounds to help prevent ignition of the building.

2. Description of the Prior Art

The use of fire prevention devices is known in the prior art. U.S. Pat. No. 5,263,543 describes a system employing roof mounted nozzles selectively activated by a smoke alarm to dispense pressurized water onto a building. Another type of fire prevention device is U.S. Pat. No. 4,330,040 disclosing a roof mounted U-shaped dispensing tube. U.S. Pat. No. 4,428,434 discloses another roof mounted system having automatic temperature sensors to activate the system. U.S. Pat. No. 5,692,571 discloses roof mounted sprinklers that are mounted in a position extending up from the roof for directing water towards the building. U.S. Pat. No. 4,091,876 discloses a pipe system for dispersing a fire preventive solution over the top of a mobile trailer roof. U.S. Pat. No. 5,165,482 discloses the use of multiple sensors to determine movement characteristics of a wildfire and multiple variously positioned sprinklers separately actuated to best inhibit the progress of the wildfire. U.S. Pat. No. Des. 399,553 shows an ornamental appearance for a sprinkler head.

While these devices fulfill their respective, particular objectives and requirements, the need remains for a system that incorporates sprinklers that are effective yet discrete and aesthetically integrated into the normal appearance of a roof.

SUMMARY OF THE INVENTION

The present invention meets the needs presented above by providing a roof and surrounding grounds wetting system that incorporates low profile roof mounted sprinkler heads that are colored to match the roofing materials of the building.

Still yet another object of the present invention is to provide a new pop up roof sprinkler system that is discrete and aesthetically pleasing so as to not detract from the appearance of the building.

Even still another object of the present invention is to provide a new pop up roof sprinkler system that effectively delivers water or a fire retardant solution directly to the roof of a building from a short distance to prevent excessive loss of water or solution to evaporation.

To this end, the present invention generally comprises a building having a roof, a fire retardant solution, a dispensing tube that has a distal portion extending outwardly from the roof, and a cap member. The cap member has a head portion and an insertion portion. The insertion portion is inserted into the dispensing tube such that the cap member is movable between an open position and a closed position. The open position is defined by the head portion being spaced from the dispensing tube to permit dispensation of the fire retardant solution through the dispensing tube.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
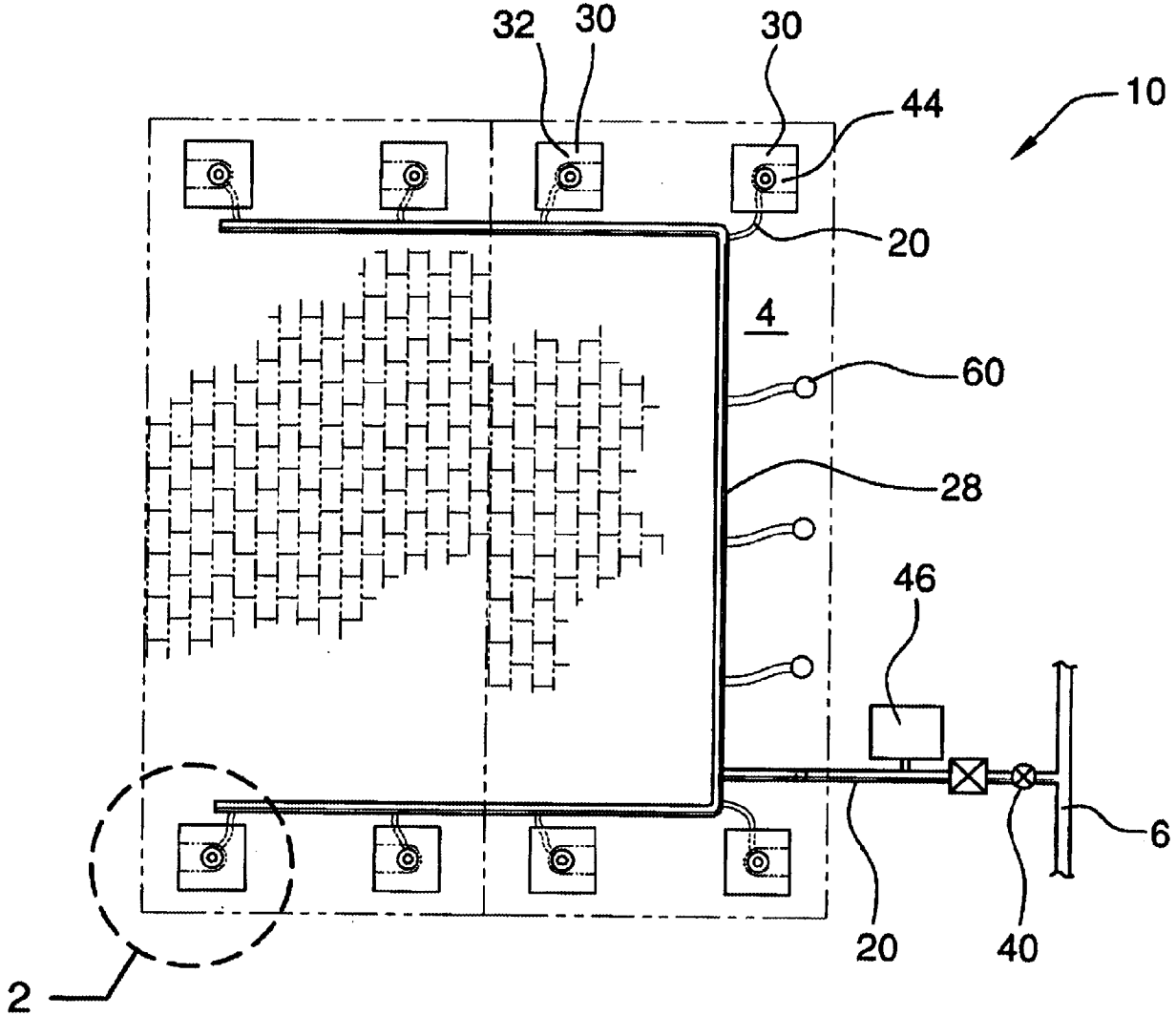
FIG. 1 is a top view of a new pop up roof sprinkler system according to the present invention.
Figure 2:
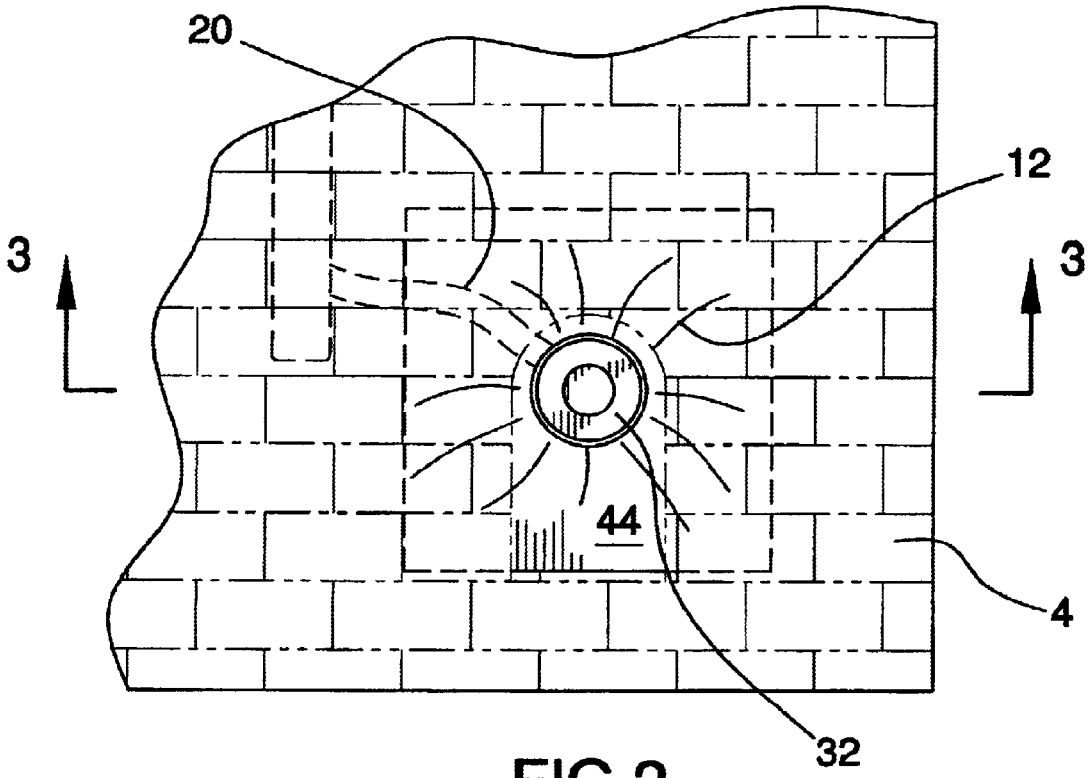
FIG. 2 is an enlarged top view of a pop up sprinkler of the present invention.
Figure 3:
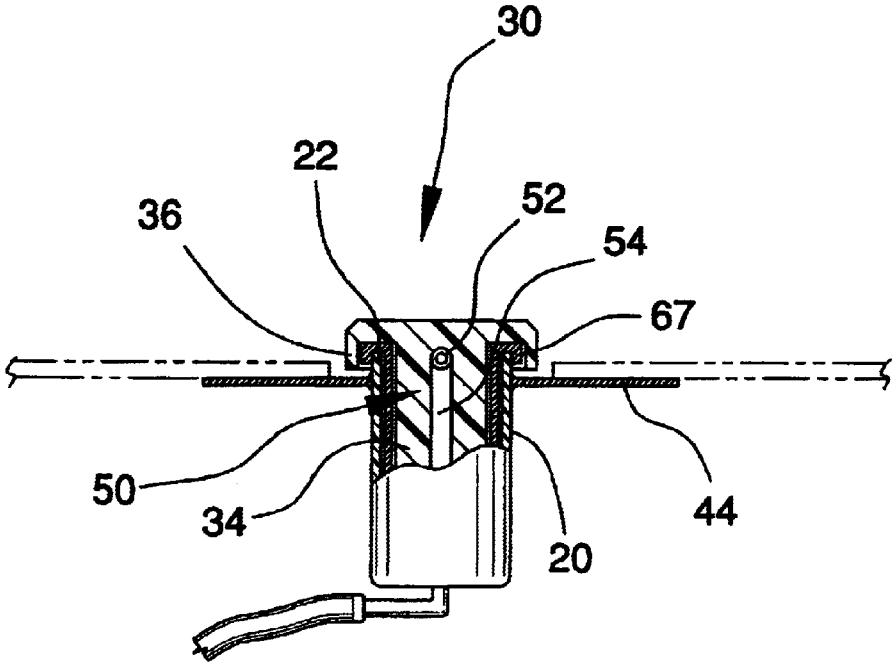
FIG. 3 is a cross-sectional view of the pop up sprinkler taken along line 3—3 of FIG. 2.
Figure 4:
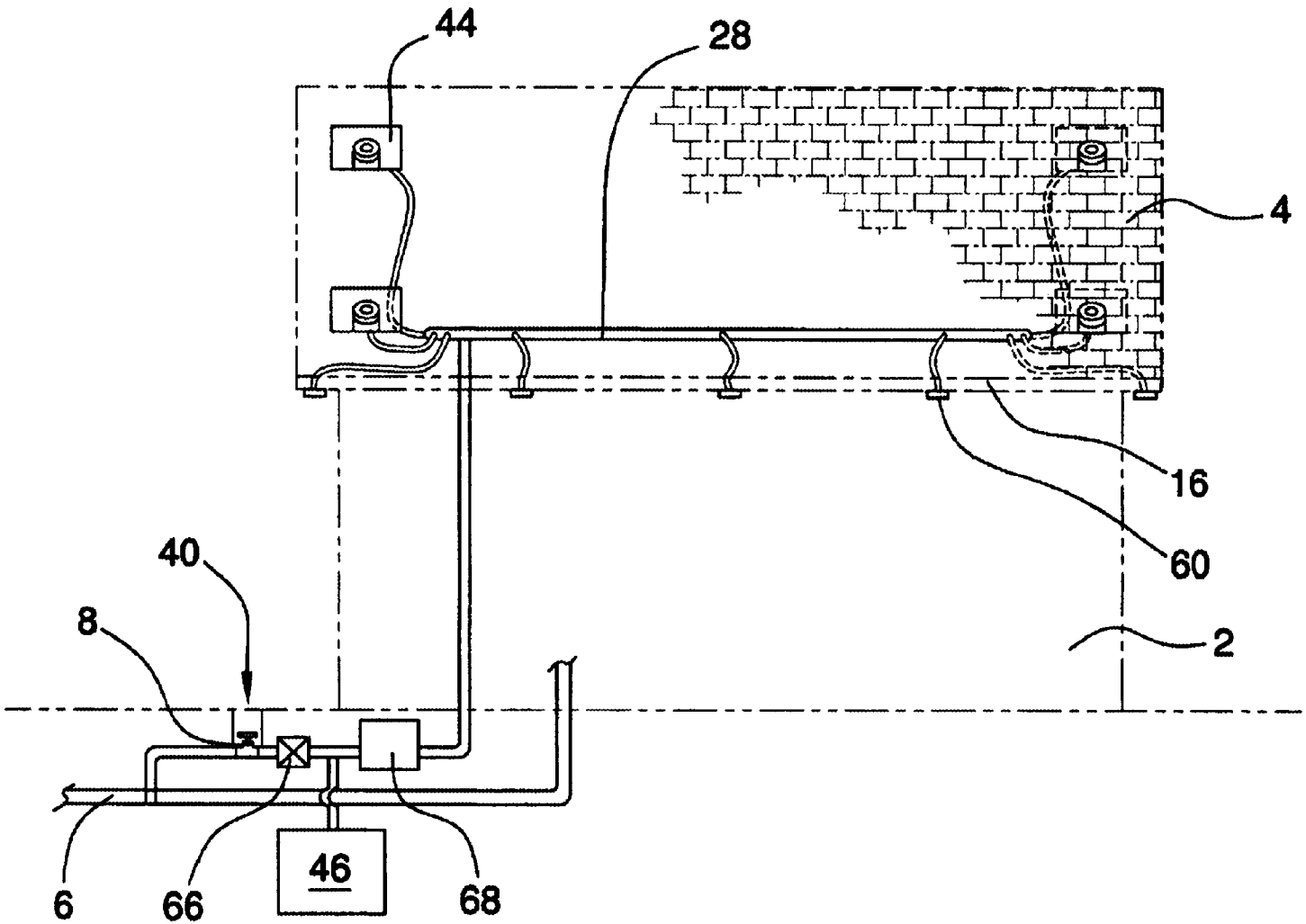
FIG. 4 is a side view of the present invention.

With reference now to the drawings, and in particular to FIGS. 1 through 4 thereof, a new pop up roof sprinkler system embodying the principles and concepts of the present invention and generally designated by the reference numeral 10 will be described.

As best illustrated in FIGS. 1 through 4, the pop up roof sprinkler system 10 generally comprises a building 2 having a roof 4, a fire retardant solution 12, a dispensing tube 20 that has a distal portion 22 extending outwardly from the roof 4, and a cap member 30. The cap member 30 has a head portion 32 and an insertion portion 34. The insertion portion 34 is inserted into the dispensing tube 20 such that the cap member 30 is movable between an open position and a closed position. The open position is defined by the head portion 32 being spaced from the dispensing tube 20 to permit dispensation of the fire retardant solution 12 through the dispensing tube 20. A diameter of the dispensing tube is greater than an outer diameter of the insertion portion 34 of the cap member 30. Thus, the fire retardant solution 12 is distributed outwardly around the dispensing tube 20 onto the roof 4 when the head portion 32 is spaced from the dispensing tube 20. The cap member may have a liner 67 to facilitate sealing of the cap member 30 with the dispensing tube 20 in the closed position.

An activation means 40 is provided for selectively activating the sprinkler system 10 to dispense the fire retardant solution 12 through the dispensing tube 20. Pressure from the fire retardant solution 12 urges the cap member 30 into the open position as the fire retardant solution 12 is dispensed. The activation means may be automated in response to pre-determined conditions such as temperature, smoke detection, or fire detection.

A retaining means 50 is provided for preventing the insertion portion 34 from being removed from the dispensing tube 20 by pressure of the dispensation of the fire retardant solution 12. In an embodiment, the retaining means 50 comprises a pin 52 extending through the dispensing tube 20 proximate an open end 23 of the dispensing tube 20. A slot 54 extends through the insertion portion 34 of the cap member 30 and the pin 52 is positioned in the slot 54.

The cap portion 30 includes a downwardly extending lip 36 for directing the fire retardant solution 12 towards a surface of the building 2 to minimize evaporation of the fire retardant solution 12 as the fire retardant solution 12 is distributed.

Flashing 44 is coupled to the dispensing tube 20 for incorporation into the roofing of the building. Visually exposed parts including the distal portion 22 of the dispensing tube 20, the flashing 44, and the exterior of the cap member 30 are colored to match coloring of the roof 4 of the building 2. Internally or nonvisible portions of the above parts need not be but may be colored to match the roof.

Typically, the fire retardant solution 12 is water and the dispensing tube 20 is coupled to a main water supply line 6. A main control valve 8 may be used as the activation means. The main control valve is operationally coupled to the dispensing tube 20 between the main water supply line 6 and the building 2 to permit remote activation of the system 10.

Optionally, a reservoir tank 46 holding a fire retardant is environmentally coupled with the dispensing tube 20 downstream of the water source. Thus, the fire retardant mixes with water from the main water line to form the fire retardant solution 12 that is dispensed.

In most cases, a single external point of dispensation is not desired. In such cases, the dispensing tube 20 forms a supply line 28 extending around the roof of the building. The supply line 28 has a plurality of distal portions 22 extending from the roof 4 and associated cap members 30 for dispensing the fire retardant solution 12 at a plurality of locations on the roof 4. Preferably, the plurality of distal portions 22 of the supply line 28 are positioned such that dispensation of the fire retardant solution 12 covers an entirety of the roof 4 when the fire retardant solution 12 is dispensed.

Additionally, a plurality of auxiliary sprinklers 60 of conventional structure may be coupled to the supply line 28 and coupled to eaves 16 of the roof for distributing the fire retardant solution 12 onto and around the building 2.

A drain valve 66 is coupled to the dispensing tube 20 proximate the main water supply line or other fire retardant solution source for draining the dispensing tube completely to prevent freezing and sediment build up in the dispensing tube.

Another option includes an auxiliary pressure pump mechanism 68 coupled to the dispensing tube 20 for preventing insufficient pressure within the dispensing tube 20 to open the cap member during use.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A pop up roof sprinkler system comprising:

a building having a roof;

a fire retardant solution;

a dispensing tube having a distal portion extending outwardly from said roof;

a cap member having a head portion and an insertion portion, said insertion portion being inserted into said dispensing tube such that said cap member is movable between an open position and a closed position, said open position being defined by said head portion being spaced from said dispensing tube to permit dispensation of said fire retardant solution through said dispensing tube;

an activation means for selectively activating said sprinkler system to dispense said fire retardant solution through said dispensing tube such that pressure from said fire retardant solution urges said cap member into said open position as said fire retardant solution is being dispensed;

a retaining means for preventing said insertion portion from being removed from said dispensing tube by dispensation of said fire retardant solution;

wherein said retaining means comprises a pin extending through said dispensing tube proximate an open end of said dispensing tube; and said retaining means further comprising a slot extending through said insertion portion of said cap member, said pin being positioned in said slot.

2. The pop up roof sprinkler system of claim 1, further comprising:

said cap member including a downwardly extending lip for directing said fire retardant solution towards a surface of the building to minimize evaporation of said fire retardant solution as said fire retardant solution is distributed.

3. The pop up roof sprinkler system of claim 1, further comprising:

flashing coupled to said dispensing tube for being incorporated into said roof of said building.

4. The pop up roof sprinkler system of claim 3 wherein said dispensing tube, said flashing, and said cap member are colored to match coloring of said roof of said building.

5. The pop up roof sprinkler system of claim 1 wherein said fire retardant solution is water; and said dispensing tube being coupled to a main water supply line.

6. The pop up roof sprinkler system of claim 5, further comprising:

a main control valve operationally coupled to said dispensing tube between said main water supply line and said building.

7. The pop up roof sprinkler system of claim 1 further comprising:

said dispensing tube being coupled to a main water supply line; and a reservoir tank for holding a fire retardant, said reservoir tank being environmentally coupled with said dispensing tube whereby said fire retardant mixes with water from said main water line to form said fire retardant solution.

8. The pop up roof sprinkler system of claim 1 further comprising:

said dispensing tube forming a supply line extending around said roof of said building;

a plurality of auxiliary sprinklers coupled to said supply line, each of said auxiliary sprinklers being coupled to eaves of said roof for distributing said fire retardant solution onto and around said building.

9. The pop up roof sprinkler system of claim 1 wherein said dispensing tube forms a supply line having a plurality of distal portions extending from said roof for dispensing said fire retardant solution at a plurality of locations on said roof; and said cap member being one of a plurality of cap members, each cap member being inserted into an associated one of said distal portions.

10. The pop up roof sprinkler system of claim 9 wherein said plurality of distal portions of said supply line are positioned such that dispensation of said fire retardant solution covers an entirety of said roof when said fire retardant solution is dispensed.

11. The pop up roof sprinkler system of claim 1, further comprising:

said dispensing tube being coupled to a main water supply line; and a drain valve being coupled to said dispensing tube proximate said main water supply line for draining said dispensing tube to prevent freezing and sediment build up in said dispensing tube.

12.The pop up roof sprinkler system of claim 1, further comprising:

an auxiliary pressure pump mechanism coupled to said dispensing tube for preventing insufficient pressure within said dispensing tube to open said cap member during use.

* * * * *